US006142558A

United States Patent [19]

May

[11] Patent Number: 6,142,558

[45] Date of Patent: Nov. 7, 2000

[54] RECLINER WITH PRIMARY AND SECONDARY OTTOMANS

[75] Inventor: Teddy J. May, Tupelo, Miss.

[73] Assignee: Action Industries, Inc., Tupelo, Miss.

[21] Appl. No.: 09/287,351

[22] Filed: Apr. 7, 1999

Related U.S. Application Data

[60] Provisional application No. 60/080,887, Apr. 7, 1998.

[51] Int. Cl.[7] ..... A47C 1/035

[52] U.S. Cl. ..... 297/75; 297/85

[58] Field of Search ..... 297/70, 75, 76, 297/84, 85, 423.28, 423.34, 423.35

[56] References Cited

U.S. PATENT DOCUMENTS

| | | | |
|---|---|---|---|
| 3,400,975 | 9/1968 | Rogers, Jr. | 297/75 |
| 5,013,084 | 5/1991 | May | 297/85 |
| 5,169,208 | 12/1992 | Re et al. | 297/75 X |
| 5,354,116 | 10/1994 | May et al. | 297/70 X |
| 5,388,886 | 2/1995 | LaPointe et al. | 297/75 |
| 5,419,611 | 5/1995 | Cook | 297/75 X |
| 5,582,457 | 12/1996 | Komorowski | 297/75 |

*Primary Examiner*—Peter R. Brown
*Attorney, Agent, or Firm*—Pillsbury Madison & Sutro Intellectual Property Group

[57] ABSTRACT

A low-leg reclining chair disclosed includes a base, right and left sides, a seat, a back, an ottoman having a primary section and a secondary section. The seat, back and the primary and secondary sections of the ottoman are interconnected by reclining mechanisms mounted as mirror-image duplicates of each other on the sides of the chair. The reclining mechanisms permit movement of the seat, back and ottoman between a fully erect position, in which the primary section remains exposed along the chair beneath the seat with the secondary section concealed behind the primary section, and at least one reclining position, in which both the primary and secondary sections are extended with the secondary section positioned between the primary section and the seat. The reclining mechanisms include a multiple-link linkage subassembly having upper and lower forward links that interconnect the primary and secondary sections to a seat-mounting link. The secondary section is connected to the multiple-link linkage subassembly with a one-piece secondary ottoman-mounting link that is simultaneously pivotally connected to the upper forward and lower forward links.

5 Claims, 3 Drawing Sheets

RECLINER WITH PRIMARY AND SECONDARY OTTOMANS

This invention claims priority of U.S. provisional application No. 60/080,887 filed on Apr. 7, 1998, the complete disclosure of which is incorporated herein by reference.

BACKGROUND OF THE INVENTION

1. Field of the Invention

This invention relates to non-swiveling, motion furniture that reclines from an erect position to one or more reclined positions, especially low-leg motion furniture.

2. Description of the Related Art

On most reclining chairs, the base is supported from the floor by glides provided on the underside of the base. For such chairs, the actual supporting glides and feet attached thereto, if any, are commonly hidden from view. False showy feet are sometimes attached to the arm frames of the chairs, although such false showy feet are typically spaced from or barely contact the ground so as not to constitute part of the supporting structure.

Another type of reclining chair known in the art is the high-leg-style recliners, which are characterized by relatively tall legs supporting the arm frame from the floor. The base of the mechanism is supported at an elevated level between the arm frames. One such exceptional high-leg recliner is the subject of U.S. Pat. No. 5,013,084 to May, issued May 7, 1991, the complete disclosure of which is incorporated herein by reference. A commercial version of the mechanism depicted in that patent is known as the Action Industries Inc. high leg recliner 2700 mechanism.

As shown by this sequence of movements depicted in FIGS. 2–4 of the '084 patent, movement of the chair from the fully erect position (depicted in FIG. 2 of the '084 patent) to the partially or fully reclining positions (respectively depicted in FIGS. 3 and 4 of the '084 patent) requires that the primary ottoman pivot downward far below the base of the chair and behind the secondary ottoman, before being pivoted upwardly and forwardly to the extended positions.

Apparently, there is a segment of the potential market for reclining chairs which is under served. This segment is composed of potential customers who like some decorative wood showing at the lower corners of their upholstered chairs, but do not want a high-leg-style recliner. However, substitution of the reclining assembly disclosed by the '084 patent into a low-leg-style recliner is not possible, since the proximity of the floor to the chair base would cause the floor to obstruct the pivotal movement of the ottoman into its extended position.

SUMMARY OF THE INVENTION

A low-leg reclining chair disclosed herein includes a base, right and left sides, a seat, a back, and an ottoman having first and second sections. The seat, back, and first and second sections of the ottoman are interconnected by a reclining mechanism that permits movement of the seat, back and ottoman between a fully erect position and at least one reclining position. In the fully erect position, the primary section remains exposed along the chair beneath the seat with the secondary section tucked therebehind. In the reclining position, both the primary and secondary sections are fully extended with the secondary section positioned between the primary section and the seat.

BRIEF DESCRIPTION OF THE DRAWINGS

The following drawings assist in elucidating the principles of this invention. In such drawings.

DETAILED DESCRIPTION OF THE INVENTION

Although it is difficult to draw a distinct definitional line between a short-leg recliner chair and a high-leg recliner chair, a good working definition is that a high-leg recliner has at least five inches of leg protruding downwards to the floor from the lower edge of the ottoman when the chair is fully erect, and an overall style that permits a five-foot six-inch tall person to see the floor under the center of the chair when the chair is fully erect and the person is standing across the room, e.g., at a distance of fifteen feet from the chair. Often, although not essentially, a high-leg recliner has exposed wood legs, often including longitudinal (i.e., front to back) and/or transverse horizontal rungs interconnecting vertically intermediate sites on the legs and/or one another. Also, often, although not essentially, a short-leg recliner has a depending skirt around the lower margin of the upholstered frame.

For convenience in description in referring to the chair and mechanisms, the term "inboard" refers to towards the longitudinal median of the chair; "outboard" refers to the laterally, transversally outwards direction away from the longitudinal median. The terms "right" and "left" are used assuming the perspective of an occupant of the chair.

Figure 1:
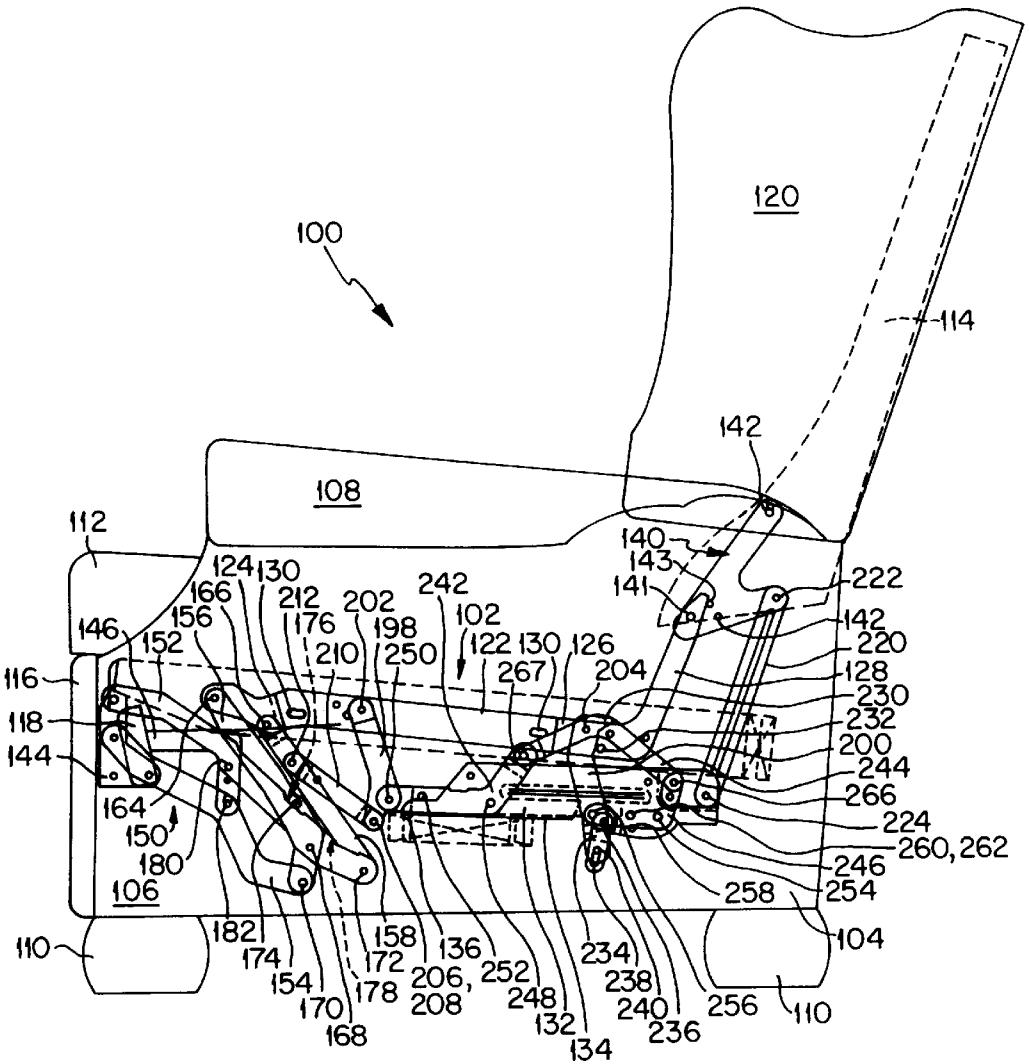
FIG. 1 is a schematic of a side elevation view of one side mechanism, particularly showing the inboard side of a right side mechanism in its fully erect position and adapted for three-way operation.

Although the chair 100 shown in FIG. 1 incorporates reclining mechanism 102, the reclining mechanism 102 is hidden by upholstery and other chair structure in FIG. 1. The chair 100 is shown in its fully-erect position in FIG. 1. In this position, the chair back is up, and the ottoman is stowed.

The chair 100 includes an upholstered base frame 104 which includes left generally vertical side 106 and right generally vertical side (not shown) topped by generally horizontal, longitudinally extending arms 108 (in this instance upholstered, rolled arms), and a set of depending legs 110 for supporting the chair 100 on a floor.

The chair base frame 104 is shown being upholstered, as arc the other components (apart from the mechanisms 102, which will be described below). Conventional upholstery of cloth and/or leather may be used, as may be synthetic sheets and composites such as "vinyl" upholstery. The mechanisms of the invention impose no particular limitations on the materials that the chair can be made of, as it is believed a person of ordinary skill in the art will readily understand. Preferred materials used for manufacturing the chair (apart from the mechanisms) include particle board, wood, mechanical fasteners, adhesive, batting, foamed plastic, chair springs, non-woven fiber, cloth and miscellaneous hardware. The mechanisms are preferably predominately made of links cut and bent from steel plate and painted matte black, these being interpivoted, connected and stopped by steel pins and rivets, with bushings of lubricous plastic sheet material interposed between members of joints. Springs are made of spring steel.

The chair 104 further includes a seat 112 and a back 114. It is conventional for recliner chairs to have two-part ottomans (which some people would call a leg-rest or a footrest), i.e., a primary ottoman 116 (the one that is exposed in FIG. 1) and a secondary ottoman 118 which, in the fully-erect position of the chair may be hidden in back of the primary ottoman 116.

The chair back 114 need not have wings 120, but wings 120 on such chairs arc a popular feature. In some low-leg recliners, the seat comprises an underlying support attached to the side mechanisms and surmounted by a loose cushion. In other instances, the support structure and cushion are built into a unitary assembly which is mounted as a whole to the side mechanisms.

In the chair 100 provided with the mechanism of the present invention, there is preferably no hand crank or motor for operating the chair. Rather, the fully-erect chair is operated by an occupant by pushing forwards on the arms 108 relative to the seat 112 to extend the ottomans 116 and 118 and move the seat 112 somewhat forwards relative to the base 104 to achieve the TV position. In instances where the chair 100 is a three-position chair, full recline is achieved from the TV position, by the occupant by pushing back with his or her shoulders on the upper part of the chair back 114, causing the chair 100 back to tilt down relative to the base 104 (and also lowering the seat relative to the base104), thereby lowering the chair/occupant composite center of gravity as reclining of the back 114 shifts the composite center of gravity rearwardly, thereby preserving tolerable stability.

Figure 2:
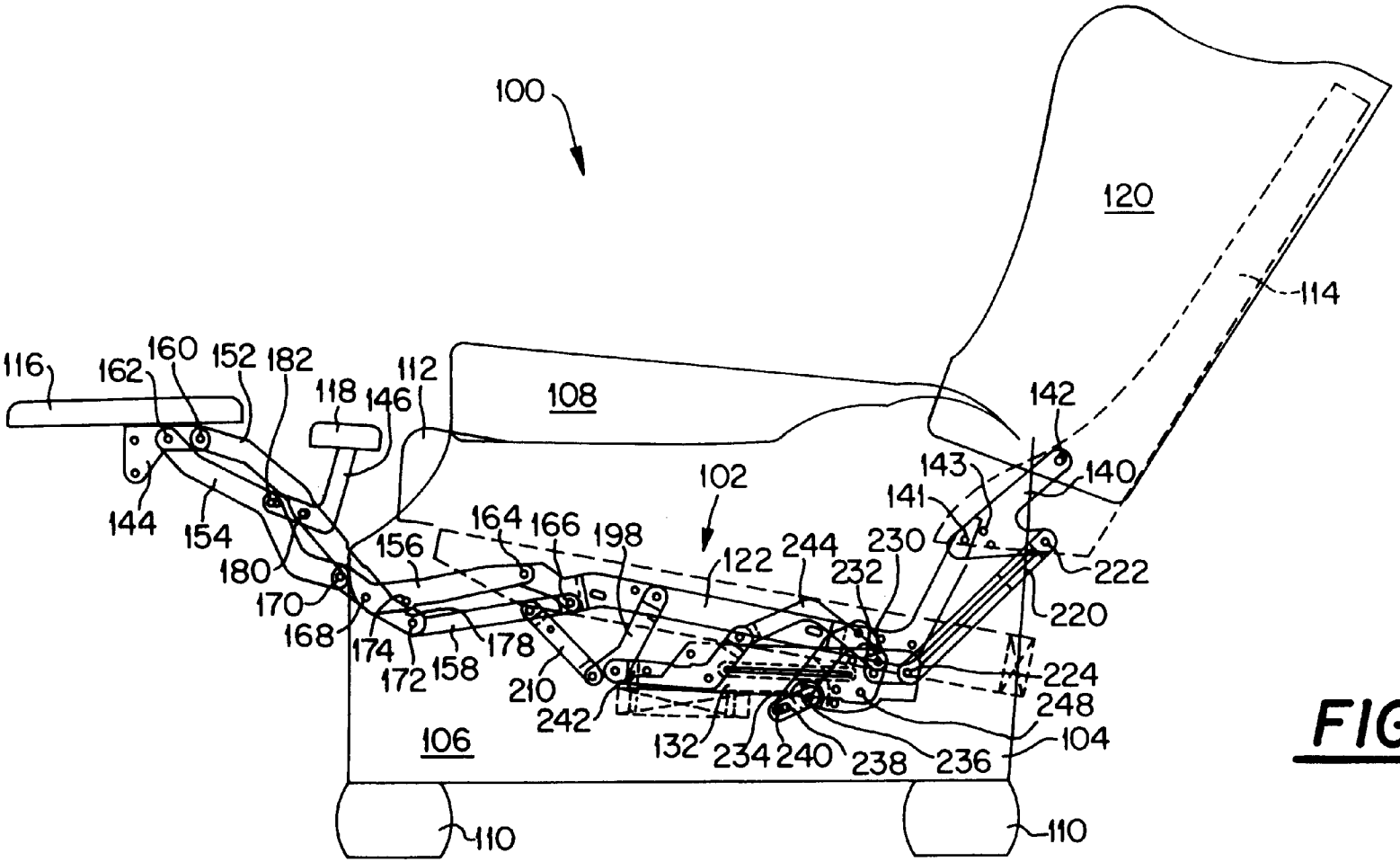
FIG. 2 is a schematic of a side elevation view of the mechanism of FIG. 1 in its TV position.
Figure 3:
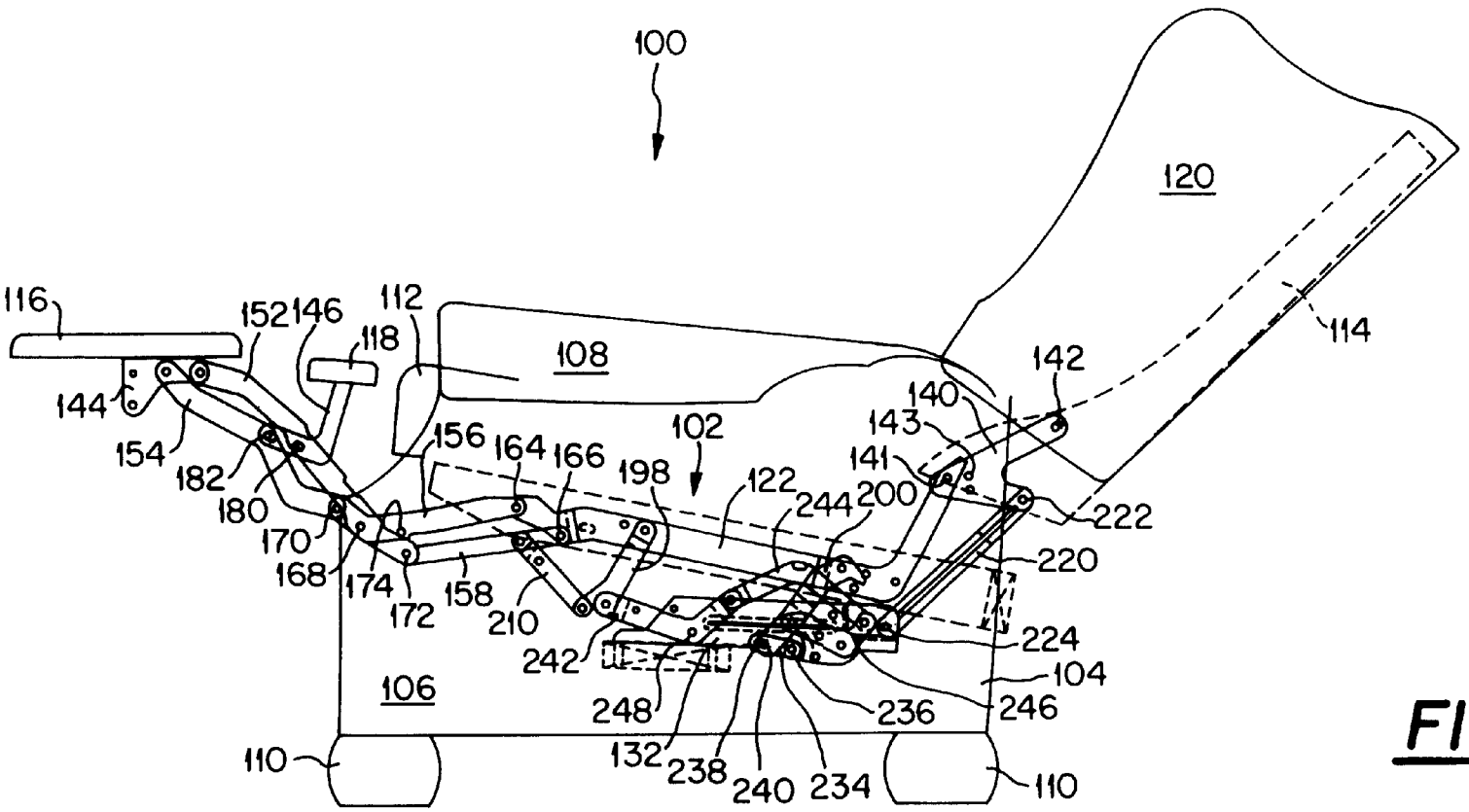
FIG. 3 is a schematic of a side elevation view of the mechanism of FIGS. 1 and 2 in its fully reclined position.

The mechanism 102 shown in FIGS. 1–3 is a right side mechanism. The chair 100 is provided with both a left side mechanism and a right side mechanism, one being a mirror image of the other, each being comparably mounted to the chair parts and the two cooperating as the chair is operated.

The mechanism 102 includes a long, upper longitudinal link 122, which, like all the links to be described is preferably stamped, bent and punched or drilled from metal plate. The links are preferably planar, except that many of the links have one or more shallow-S double bends in them, where necessary to prevent the links from interfering with position or intended loci of movement of one another. Thus, for instance, the forward end portion of the link 122 jogs inboard by one thickness at 124 and the rear portion thereof jogs inboard by three thicknesses at 126, both compared with the central portion of the long link 122. The rear portion of the link 122 is shaped as an upwardly projecting spur 128.

The central portion of the long link 122 is shown provided with a series of holes 130 to receive fasteners for fastening the mechanism to a respective side of the seat 112 of the chair 100.

The mechanism 102 further includes a base-mounting bracket 132 which is provided by a link folded along a longitudinal axis so as to have an outboard vertically-oriented, longitudinally-extending flange 134 which extends throughout approximately the rear eighty percent of the bracket 132, and a generally horizontally, inboard-extending flange at the lower extent of the flange 134, which extends throughout approximately the foremost two-thirds of the bracket 132. The flange 136 is provided with a series of holes 136 to receive fasteners for fastening a respective side 106 of the base frame 104 to the mechanism 102. The flange 134 is located inboard of the central portion of the long frame-mounting link 122 by about seven link thicknesses.

The feature indicated on the flange 134 is not a slot; rather it is an outboard-facing groove embossed in the link, which causes a corresponding low ridge extending along the inboard face of the flange 134, the purpose of such embossment being to impart improved anti-bending strength to this link. (Other links are shown having similar embossments, as will be briefly pointed out as the respective links are described in the description below.)

The link shown located furthest outboard on the mechanism 102 is the flat, V-shaped back-mounting link 140, located on the outboard side of the spur 128 of the seat-mounting link 122. The link 140 is shown provided through the thickness thereof with a series of vertically spaced holes 142 for receiving fasteners for securing the link to a respective edge of the chair back 114.

At its forward end (when in the closed position shown in FIG. 1, equating to the fully erect position of the chair), the mechanism 102 has a primary ottoman mounting bracket 144 in the form of a link folded along a line which is substantially vertical when the mechanism 102 is in its closed position, so as to have at its forward margin a face provided with a series of vertically spaced openings for mounting a corresponding end of the primary ottoman 116 thereto.

By preference, the chair 100 further includes a secondary ottoman 118, and, for mounting it, the mechanism preferably includes a secondary ottoman mounting link 146.

The links and brackets by which the mechanism 102 unites the chair 100 into a unitary structure carried on the chair base have all been introduced above; the remainder of the description relates how the links and brackets of a mechanism 102 are interconnected and how they interact in use. Unless the contrary appears, all of the rivets, pivot joints and pins described below have transverse horizontally-extending main axes (i.e., their own longitudinal axes extend crosswise of the chair and are horizontal). Even if not specifically mentioned, any of the pivot joints can include washer-like bushings, e.g., made of a lubricous synthetic plastic material such as nylon, between the interpivoted parts and/or between the pivot pin head and/or upset tail and the respective adjacent part. And any stop pin or mounting pin may be a plain metal pin, or, where cushioning or noise-reduction is a consideration, a metal pin sleeved with a tubular bushing of lubricous synthetic plastic material such as nylon.

A multiple-link lazy tongs-type linkage 150 is provided at the front end of the seat-mounting link 122 for mounting the primary ottoman-mounting bracket 144 and secondary ottoman-mounting link 146.

The linkage 150 is shown comprising upper and lower forward links 152, 154 and upper and lower rear links 156, 158.

The front ends of the upper and lower forward links 152, 154 are connected one above the other (in the closed position of the mechanism in FIG. 1) to the longitudinal flange of the primary ottoman mounting bracket 144 by respective pivot joints 160, 162.

The rear ends of the upper and lower rear links 156, 158 are connected one in front of and above the other to the forward portion of the seat-mounting link 122 by respective pivot joints 164, 166.

A pivot joint 168 is provided where the upper forward link 152 crosses the upper rear link 156, located approximately eighty percent down from the upper ends of these links. The lower end of the lower front link 154 is connected to the lower end of the upper rear link 156 by a pivot joint 170, and the lower end of the upper front link 152 is connected to the lower end of the lower rear link 158 by a pivot joint 172. In the preferred embodiment, the upper rear link 156 is flat, the central approximately eighty percent of the lower front link 154 is jogged outboards by about two link thicknesses, and the upper approximately twenty percent of the upper and lower rear links 156 and 158 are jogged outboards by about three link thicknesses.

An inboard-extending pin 174 provided on the upper rear link 156 about one-third back from its front end is available to engage the upper edge of the upper front link 152 at 176 and 178 to provide respective stops limiting retraction and extension of the lazy tongs linkage as the primary ottoman is stowed and deployed.

The secondary ottoman mounting link 146 is connected to upper front link 152 at joint 180 and to lower front link 154 at joint 182, which (as depicted in the fully erect position of FIG. 1) is vertically below joint 180. Accordingly, as the primary ottoman 116 is extended from its stowed, on edge, location under the front lip of the seat 112, the secondary ottoman-mounting link 146 pivots the secondary ottoman 118 through approximately ninety degrees back towards the seat 112 (clockwise in the figures). The secondary ottoman 118 is thereby moved from a vertically oriented position behind the primary ottoman 116 (see FIG. 1) to a horizontal position (see FIGS. 2 and 3) substantially horizontal and coplanar with primary ottoman 116, with joint 182 positioned slightly higher than joint 180.

The seat-mounting link 122 is shown provided with front and rear depending links 198, 200 respectively connected at their upper ends to the central portion of the link 122 about one-third back from the front end of the link 122 by a pivot joint 202, and to the base of the spur 128 near the rear end of the link 122 by a pivot joint 204.

The front depending link 198 has a depending toe 206 projecting forwards. The lower sixty percent of the link 198 is jogged inboards about four link thicknesses compared to the upper twenty percent thereof. The toe 206 includes joint 208.

An ottoman lazy tongs operator link 210 has a rear, lower end connected to the toe 206 of the front depending link 198 by the pivot joint 208, and a front, upper end connected to a site on the lower rear link 158 of the lazy tongs about forty percent of the way down from the upper end of that link, by a pivot joint 212.

Accordingly, when the front depending link 198 swings forwards about its upper end 202, the operator link 210 has its rear, lower end pushed towards the pivot joints by which the upper and lower rear links 156 and 158 are connected to the base-mounting link 122, thereby extending the lazy tongs and thrusting the ottoman 116. The reverse happens as the front depending link swings 198 rearwards about its upper end 202.

The back-mounting link 140 is a generally V-shaped link the rear leg of which is shown being somewhat less tall than the forward leg thereof. One of the holes for mounting the back is shown provided at the upper end of the forward leg, and the other is shown provided about forty percent up the rear leg from the lower end. The back-mounting link 140 is shown connected near its lower end, in the region where its legs join, to the spur 128 of the seat-mounting link 122, near the upper end of the spur 128, by a pivot joint 141.

About three-quarters of an inch about the joint 141, the link 140 is provided with an inboard-projecting pin 143 which is available to engage the rear edge of the spur 128 above the joint 141 as the chair 100 is erected for defining the location of the back in the fully-erect position of the chair and helping to maintain the back tightly in place in the closed position of the mechanism.

The mechanism 102 further includes an operator link 220 for the back-mounting link 140. The operator link 220 has an upper end connected to the upper end of the rear leg of the back-mounting link 140 by a pivot joint 222, and a lower end connected to the rear end of the vertical, longitudinal flange of the base-mounting bracket 132 by a pivot joint 224. Accordingly, when the base-mounting bracket 132 translates forwards relative to the seat-mounting link 122, and the latter tips upwards to the front slightly as the mechanism opens from the fully closed (FIG. 1) to the TV position (FIG. 2), the operator link 220 mainly merely pivots forwards around its upper end, but also is pulled slightly downwards in a translational sense, so that the back-mounting link 140 tilts slightly to the rear, thus slightly tilting the back of the chair 100.

The upper ten percent of the operator link 220 is jogged about five link-thicknesses outboards relative to the lowest two-thirds of that link. An impressed stiffening ridge is also present at 222.

If the chair 100 is provided to have a third, fully-reclined position (FIG. 3), in achieving this position from the TV position (by means hereinafter more fully described), the front of the seat-mounting link 122 raises about one and a quarter inches, and the rear of the seat-mounting link 122 raises about one half of an inch and the seat-mounting link 122 swings rearwards about one-quarter of an inch. This action, in combination, pulls downwards and forwards on the back-mounting link operating link 220, causing the latter to rotate rearwardly about its connection to the spur 128 by about fifteen degrees, thereby reclining the chair back.

The remaining structure of the mechanism 102 mounts the base-mounting bracket 132 to the seat-mounting bracket and operates the base-mounting bracket 132 in relation to the seat-mounting bracket, also causing operation of ottoman and chair back as has been described above. The remaining structure of the mechanism 102 is the most difficult to visualize because it is, in general, sandwiched between the longitudinal flange of the base-mounting bracket 132 and the seat-mounting link 122.

The upper end of the rear depending link 200 is shown provided with a rearwardly-extending prong 230. The base link 122 is shown provided at the base of the spur 128, behind and below the pivot joint 204 connecting the upper end of the rear depending link 200 to the seat-mounting link 122, with an inboards-extending pin 232. The pin 232 engages the lower edge of the prong 230 to limit forwards swinging of the rear depending link 200 (and therefore the front depending link 198 and the seat-mounting bracket) relative to the seat-mounting link 122, as the mechanism 102 opens from the closed to the TV position thereof.

A longitudinally short control link 234 is connected by its upper, rear end to the vertical longitudinal flange of the base-mounting bracket 132 about twenty-five percent forwards from the rear end of the base-mounting bracket 132 and about one-fourth of an inch below the inboards-extending flange of the base-mounting bracket 132, by a pivot joint 236. The link 234 is about two inches long. Its forward, lower end is jogged outboards relative to its rear, upper end by about three link thicknesses. That outer portion is provided with a slot 238, elongated along the length of the link 234, and a sliding, pivotal connection is made between such portion and the lower end of the rear depending link 200 by a pivot joint 240 which can slide along the slot 238.

When the mechanism 102 is closed, the link 234 projects downwards and slightly forwards and the pivot joint 240 is located at the upper end of the slot 238. As the mechanism opens from the closed position (FIG. 1) to the TV position (FIG. 2), the link 234 pivots forwards about fifty degrees about its upper end as the pivot joint 240 slides to bottom of the slot 238. As the mechanism 102 moves from the TV position to the fully-reclined position, the link rotates approximately seventy degrees further in the same direction (so that the control link projects upwards and forwards at about a forty-five degree angle) and the pivot joint 240 slides back to the same end of the slot it occupied in the closed (FIG. 1) position. (Because the control link has rotated so much between its FIG. 1 and FIG. 3 positions that it has become generally inverted, the lower end of the slot 238 in FIG. 1 will be called its outer end, and the upper end of the slot 238 in FIG. 1 will be called its inner end, both relative to the pivot joint 236.)

The mechanism 102 further includes three boomerang (or arcuate)-shaped links, namely a forward long one 242, which is concave upwards, a rear long one 244, which is concave downwards, and, under the rear half of the rear long arcuate link, a rear short arcuate link 246, which is concave upwards.

The forward upwardly-concave arcuate link 242 is connected in its central elbow region to the vertical longitudinal flange of the base-mounting bracket 132 near the fold line of the base-mounting bracket 132, about one-third of the way back from the front end of the base-mounting bracket 132, by a pivot joint 248. The front end portion (about three-quarters of an inch) of the link 242 is jogged outboards by about two link thicknesses, and about the same amount of the rear end portion is jogged outboards by about one link thickness.

The front end of the link 242 is connected to the base of the upright standard of the front depending link 198 by a pivot joint 250.

In the closed position (and in the TV position), an inboards-projecting pin 252 provided on the front arm of the link 242 about two-thirds of the way forwards along that arm from the pivot joint 248, engages on a recessed upper edge region of the vertical longitudinal flange of the seat-mounting bracket.

In the fully-reclined position (FIG. 3), an upper edge portion of the link 242, forwardly of the pivot joint 248, engages an outboards-extending pin provided on the vertical, longitudinal flange of the base-mounting bracket for limiting tilting-down of the back and raising of the seat, both relative to the base-mounting link 122.

The rear upwardly-concave link 246 is connected at its central bend to the vertical, longitudinal flange of the base-mounting bracket at the rear end of the latter, below the connection of the lower end of the back-operating link to that flange, by a pivot joint 254.

The forward end of the rear upwardly-concave link 246 is connected to the rear depending link 200 about forty percent of the way up from the lower end of the latter, by a pivot joint 256.

The link 246 remains immobile as the mechanism moves between its fully closed (FIG. 1) and TV (FIG. 2) positions, with an outboards-projecting pin 258 on the vertical, longitudinal flange of the base-mounting bracket 132 engaging the lower edge of the link 246 approximately midway between the pivot joints 248 and 256.

The mechanism 102 is shown provided with aligned openings 260, 262 through the vertical, longitudinal flange of the base-mounting bracket 132 above the pin 258 and through the link 246. For restricting the chair 100 to having only a fully-erect and a TV position, a rivet can be installed through the aligned openings 260, 262, as well.

The rear, concave-downwards link 244 has its rear end connected to the rear end of the link 246 by a pivot joint 266 and its front end connected to the rear end of the forward concave-upwards link 242 by a pivot joint 267. The links 242, 244, 246, and 247 remain immobile as the mechanism 102 moves between its closed (FIG. 1) and TV (FIG. 2) positions.

As the mechanism 102 moves from the TV position (FIG. 2) to the fully-reclined position (FIG. 3), the forward, upwardly-arcuate link 242 rocks towards the rear about its central pivot joint, thus raising the front of the seat-mounting link 122 relative to the base-mounting bracket 1322, shifting the rear, downwardly-concave link 244 rearwards, thereby raising the rear of the seat-mounting link 122.

The raising of the rear of the seat-mounting link pulls down the lower end of the back-operating link, thereby fully reclining the chair back.

When the mechanism is in its TV position (FIG. 2), the ottoman can be retracted by the occupant by pulling backwards with his or her heels on the front edge of the primary ottoman 116, while pushing forwards on the arms 108 the chair. However, when the chair 102 is in its fully-reclined position, the pivotal connection of the front end of the rear upwardly-concave link to the intermediate location on the rear depending link forces the pivot joint at the lower end of the rear depending link along the slot in which it is mounted, to the inner end of that slot, and the angular orientation of the link in which the slot is provided then prevents the rear depending link from swinging about its upper end pivot joint, thus preventing the ottoman from being retracted. In other words, the ottoman-mounting lazy tongs is locked in an extended condition so long as the chair back is fully reclined.

In the preferred embodiment, the seat-mounting link is about sixteen inches long (as projected onto a horizontal, longitudinally-extending line, i.e., not adding five more inches for the distance up the spur 128, but only the about two inches that the spur projects rearwards of its own base on the link 122).

Erecting the chair from a reclined position, to a TV position, and to a fully-erect position involves a reversal of the steps explained above. The weight of the person, concentrating on the seat, pushes the seat down, pulling up the back, whereupon ottoman retraction is assisted by the person's heels.

It should now be apparent that the mechanism for low-leg reclining chair as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A low-leg reclining chair comprising:

a base;

right and left sides;

a seat;

a back;

an ottoman having a primary section and a secondary section, and reclining mechanisms mounted as mirror-image duplicates of each other at said right and left sides of said chair, respectively, said reclining mechanisms interconnecting said seat, said back, and said primary and secondary sections of said ottoman so as to permit movement of said seat, said back and said ottoman between a fully erect position, in which said primary section is exposed beneath said seat and said secondary section is concealed behind said primary section, and at least one reclining position, in which both said primary and secondary sections are extended with said secondary section positioned between said primary section and said seat, wherein each of said reclining mechanisms comprises an upper longitudinal seat-mounting link and a multiple-link linkage subassembly provided at a front end of said seat that interconnects said primary and secondary sections to said upper longitudinal seat-mounting link; said multiple-link linkage subassembly comprising:

an upper forward link and a lower forward link vertically spaced from each other and each having respective forward ends and rear ends, said forward ends being pivotally connected to said primary section, said rear ends being interconnected to said seat-mounting link; and a one-piece secondary ottoman-mounting link having first and second ends, said first end being connected to said secondary section and said second end being pivotally connected at an intermediate position of said lower forward link, said secondary ottoman-mounting link further comprising an intermediate portion positioned between said first and second ends, said intermediate portion being pivotally connected to said upper forward link at an intermediate position of said upper forward link.

2. A low-leg reclining chair according to claim 1, said multiple-link linkage subassembly further comprises a lower rear link and an upper rear link for respectively interconnecting said upper forward link and said lower forward link to said seat-mounting link.

3. A low-leg reclining chair according to claim 2, wherein:

said rear end of said lower front link is pivotally connected to a forward end of said upper rear link;

said rear end of said upper front link is pivotally connected to a forward end of said lower rear link;

said upper forward link crosses and is pivotally connected to said upper rear link.

4. A low-leg reclining chair according to claim 1, wherein said seat-mounting link is carried by said sides of said chair.

5. A low-leg reclining chair according to claim 1, wherein said secondary ottoman-mounting link comprises a stem portion extending from said secondary section and a lower leg portion generally perpendicular to said stem portion and spaced from said secondary section by said stem portion, wherein in the fully erect position said stem portion is oriented substantially horizontally and said lower leg is oriented substantially vertically, and further wherein in the reclined position said stem portion is oriented substantially vertically and said lower leg is oriented substantially horizontally.

* * * * *